US011638951B2

(12) United States Patent
Yuki et al.

(10) Patent No.: US 11,638,951 B2
(45) Date of Patent: May 2, 2023

(54) HEATING METHOD FOR CASTING MOLD, AND CASTING DEVICE

(71) Applicant: HONDA MOTOR CO., LTD., Tokyo (JP)

(72) Inventors: Kenji Yuki, Tokyo (JP); Ryo Onishi, Tokyo (JP); Satoru Kimura, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/681,940

(22) Filed: Feb. 28, 2022

(65) Prior Publication Data

US 2022/0314305 A1 Oct. 6, 2022

(30) Foreign Application Priority Data

Mar. 31, 2021 (JP) ..... 2021-059106

(51) Int. Cl.

| | |
|---|---|
| ***B22C 9/06*** | (2006.01) |
| ***B22D 18/08*** | (2006.01) |
| ***B22D 18/06*** | (2006.01) |
| ***B22C 9/08*** | (2006.01) |

(52) U.S. Cl.

CPC ..... *B22C 9/065* (2013.01); *B22C 9/067* (2013.01); *B22C 9/08* (2013.01); *B22D 18/06* (2013.01); *B22D 18/08* (2013.01)

(58) Field of Classification Search

CPC ..... B22C 9/065; B22C 9/067; B22C 9/08; B22D 18/06; B22D 18/08

See application file for complete search history.

(56) References Cited

U.S. PATENT DOCUMENTS

2010/0243191 A1* 9/2010 Nishikawa ..... B22D 17/24 164/113

FOREIGN PATENT DOCUMENTS

| | | |
|---|---|---|
| JP | 5717692 | 5/2015 |
| JP | 6095379 | 3/2017 |

* cited by examiner

*Primary Examiner* — Kevin P Kerns
*Assistant Examiner* — Steven S Ha
(74) *Attorney, Agent, or Firm* — Amin, Turocy & Watson, LLP

(57) ABSTRACT

A casting mold is provided with a cavity portion and an overflow portion, and the overflow portion is connected to a gas flow path (suction path). A valve (an on-off valve, a shut-off valve) is provided between the gas flow path and the overflow portion. A heating method for a casting mold includes a step of setting the pressure in the cavity portion to a second pressure by sucking gas in the overflow portion and in the cavity portion while the valve is kept open for a second time period shorter than a first time period during casting. The heating method further includes a step of heating the casting mold by supplying molten metal into the cavity portion set at the second pressure, and solidifying the molten metal.

10 Claims, 2 Drawing Sheets

HEATING METHOD FOR CASTING MOLD, AND CASTING DEVICE

CROSS-REFERENCE TO RELATED APPLICATIONS

This application is based upon and claims the benefit of priority from Japanese Patent Application No. 2021-059106 filed on Mar. 31, 2021, the contents of which are incorporated herein by reference.

BACKGROUND OF THE INVENTION

Field of the Invention

The present invention relates to a heating method for a casting mold, and to a casting device.

Description of the Related Art

Prior to casting for producing a product, casting (preheating shot) for preheating of a casting mold may be performed (for example, JP 5717692 B2). In the preheating shot, the casting mold is heated by injecting molten metal into the cavity of the casting mold and solidifying the molten metal. The molten metal (cast article) solidified by the preheating shot is not used as a product.

The casting mold includes an overflow portion downstream of the cavity. The overflow portion performs various functions during casting. For example, the overflow portion has a function of filling a product portion with molten metal. This reduces defects in the cast article due to solidification shrinkage. Further, the overflow portion has a function of removing the molten metal mixed with gas, from the product portion. This reduces defects in the cast article caused by the mixing of gas into the molten metal. However, the portion of the cast article that has solidified in the overflow portion sticks to the mold when the cast article is released, and is thus liable to be broken. Broken pieces of the cast article may remain in the mold and interfere with subsequent casting. For example, pieces of the cast article sandwiched between the molds may cause the mold to be poorly sealed. Therefore, it is necessary to confirm whether the cast article is completely released from not only the product portion but also from the overflow portion. In order to confirm the release of the cast article, it is necessary to fill the overflow portion with molten metal. This is because, if the overflow portion is not filled at the time of casting, it is difficult to distinguish the defective release from the defective filling. That is, it is necessary that the overflow portion is filled not only in the casting for producing a product but also in the preheating shot.

Here, in order to suppress the occurrence of defects (for example, blow holes) caused by the mixing of gas into the molten metal, vacuum casting is used. In the vacuum casting, casting is performed after gas in the cavity is sucked. Therefore, in the vacuum casting, the mold is sealed in order to prevent air from leaking into the cavity. In particular, in high vacuum casting, a tight seal is required for depressurizing the cavity to near vacuum. In the vacuum casting, if gas remains in the cavity, the portion where the gas remains is not filled with the molten metal. As a result, filling of the molten metal in the overflow portion is hindered. Thus, in the vacuum casting, it is desirable to depressurize the cavity in order to fill the overflow portion with the molten metal even in the preheating shot.

Here, the preheating shot is performed in a state where the mold is not sufficiently heated. Therefore, powder burrs (molten metal powder) are liable to occur in the preheating shot. In the subsequent pressure reduction, the powder burrs adhere to the periphery of a pressure reducing shut-off valve (shut-off valve), whereby the powder burrs may be caught in the seal portion of the shut-off valve. In the vacuum casting, the shut-off valve disposed downstream of the overflow portion prevents the molten metal from flowing into a pressure reducing path (gas flow path). If foreign matter is caught in the seal portion of the shut-off valve, the shut-off valve may not be completely closed when the molten metal is filled, and the molten metal may flow into the pressure reducing path.

SUMMARY OF THE INVENTION

Thus, in the heating method for the casting mold, and the casting device, there is a problem that foreign matter is caught in the seal portion of the shut-off valve. An object of the present invention is to solve the above-mentioned problem.

According to an aspect of the present invention, provided is a heating method for a casting mold for heating the casting mold before casting is performed, wherein the casting mold includes, on an inside thereof, a cavity portion, and an overflow portion connected to the cavity portion, the overflow portion is connected to a gas flow path provided inside or outside the casting mold, a valve is provided between the gas flow path and the overflow portion, and wherein a step of performing the casting comprises: a first suction step of setting a pressure in the gas flow path to a predetermined pressure by sucking gas in the gas flow path in a state in which the valve is closed; a second suction step of setting a pressure in the cavity portion to a first pressure by sucking gas in the overflow portion and in the cavity portion through the gas flow path set at the predetermined pressure while keeping the valve open for a first time period; a step of supplying molten metal into the cavity portion set at the first pressure, and solidifying the molten metal; and a step of taking out, as a product, a cast article obtained by solidifying the molten metal, the heating method comprising: a third suction step of setting the pressure in the gas flow path to the predetermined pressure in the state in which the valve is closed; a fourth suction step of setting the pressure in the cavity portion to a second pressure by sucking the gas in the overflow portion and in the cavity portion through the gas flow path set at the predetermined pressure while keeping the valve open for a second time period shorter than the first time period; a step of supplying the molten metal into the cavity portion set at the second pressure and solidifying the molten metal to heat the casting mold; and a step of taking out, as a test article, a cast article obtained by solidifying the molten metal.

A casting device that heats a casting mold before casting is performed, the casting mold including, on an inside thereof, a cavity portion, and an overflow portion connected to the cavity portion, the casting device comprising: a gas suction unit configured to suck gas in the overflow portion and in the cavity portion through a gas flow path provided inside or outside the casting mold; a valve provided between the gas flow path and the overflow portion; a molten metal supply unit configured to supply molten metal into the cavity portion; and a control unit configured to control the valve, the gas suction unit, and the molten metal supply unit, wherein during casting, the control unit executes: a first suction step of setting a pressure in the gas flow path to a predetermined pressure by controlling the gas suction unit and the valve to cause the gas suction unit to suck gas in the gas flow path in a state in which the valve is closed; a second suction step of setting a pressure in the cavity portion to a first pressure by controlling the gas suction unit and the valve to cause the gas suction unit to suck gas in the overflow portion and in the cavity portion through the gas flow path set at the predetermined pressure while the valve is kept open for a first time period; and a step of controlling the molten metal supply unit to supply molten metal into the cavity portion set at the first pressure and solidify the molten metal, and during heating, the control unit causes the casting mold to be heated by executing: a third suction step of setting the pressure in the gas flow path to the predetermined pressure by controlling the gas suction unit and the valve to cause the gas suction unit to suck the gas in the gas flow path in the state in which the valve is closed; a fourth suction step of setting the pressure in the cavity portion to a second pressure by controlling the gas suction unit and the valve to cause the gas suction unit to suck the gas in the overflow portion and in the cavity portion through the gas flow path set at the predetermined pressure while the valve is kept open for a second time period shorter than the first time period; and a step of controlling the molten metal supply unit to supply the molten metal into the cavity portion set at the second pressure and solidify the molten metal.

According to the present invention, it is possible to provide a heating method for a casting mold, and a casting device, with which foreign matter is prevented from being caught in the seal portion of the shut-off valve.

The above and other objects, features, and advantages of the present invention will become more apparent from the following description when taken in conjunction with the accompanying drawings, in which a preferred embodiment of the present invention is shown by way of illustrative example.

DESCRIPTION OF THE INVENTION

Hereinafter, a heating method for a casting mold, and a casting device according to an embodiment of the present invention will be described.

Figure 1:
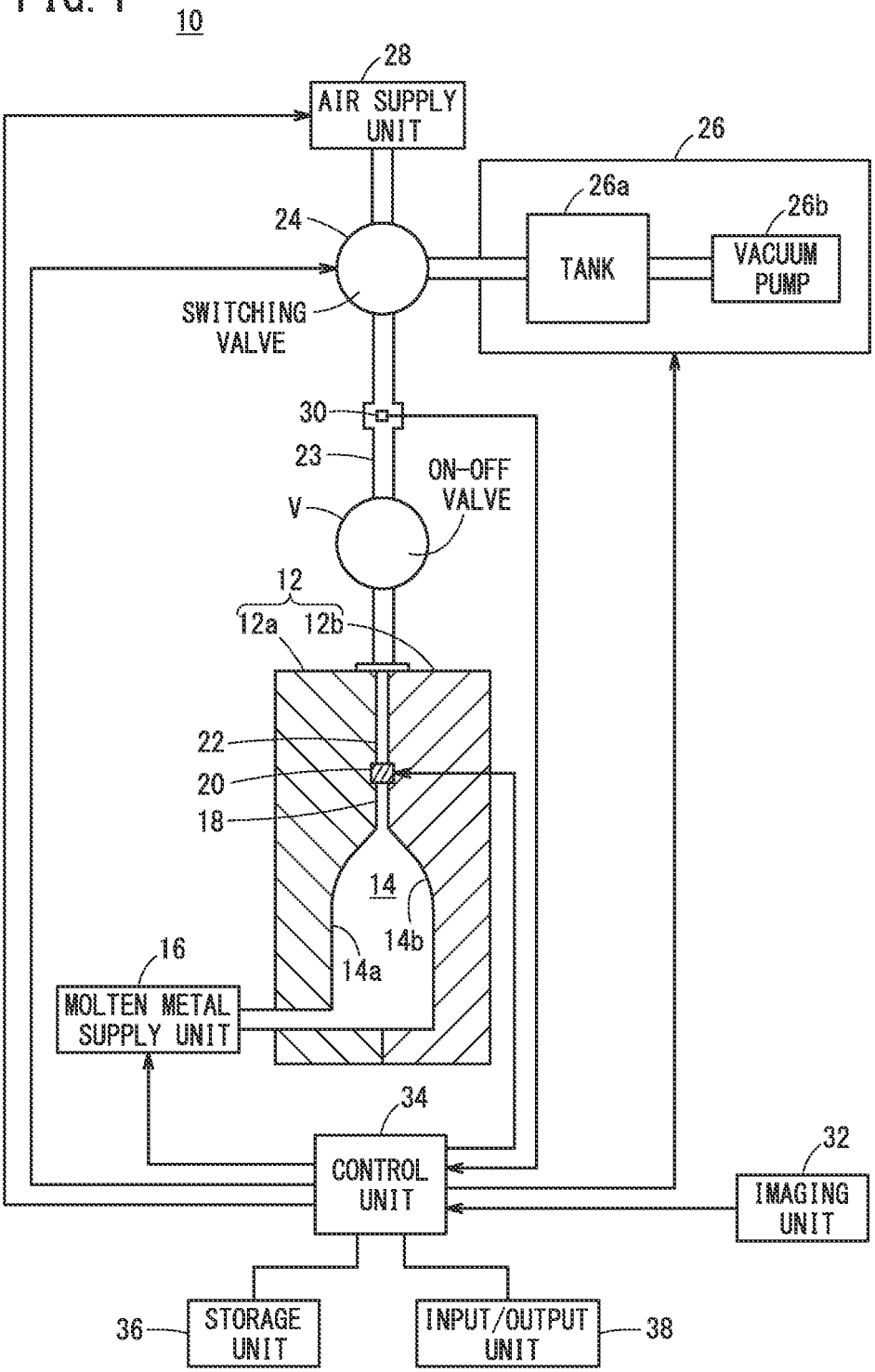
FIG. 1 is a view showing a casting device according to an embodiment of the present invention.

A casting device 10 shown in FIG. 1 includes a casting mold 12. The casting mold 12 includes a fixed mold 12*a* and a movable mold 12*b* which face each other in the left-right direction (horizontal direction) of the drawing. The movable mold 12*b* moves in the horizontal direction so as to be able to contact and separate from the fixed mold 12*a*. The fixed mold 12*a* and the movable mold 12*b* have mating surfaces facing each other. The mating surface of the fixed mold 12*a* and the mating surface of the movable mold 12*b* have a concave portion 14*a* and a concave portion 14*b*, respectively. The concave portion 14*a* and the concave portion 14*b* form a cavity portion 14. By bringing the movable mold 12*b* into contact with the fixed mold 12*a*, the casting mold 12 is closed. As a result, the cavity portion 14 is formed inside the casting mold 12.

The casting device 10 includes a molten metal supply unit 16. The molten metal supply unit 16 is attached to the fixed mold 12*a* and supplies molten metal into the cavity portion 14. The movable mold 12*b* has an overflow portion 18 downstream of the cavity portion 14. The molten metal supplied to the cavity portion 14 reaches the overflow portion 18. Thereafter, the molten metal solidifies inside the cavity portion 14 and the overflow portion 18. The solidified molten metal is taken out from the casting mold 12 as a cast article.

The casting mold 12 includes a shut-off valve 20 and a suction path 22. The shut-off valve 20 is connected between the overflow portion 18 and the suction path 22. The shut-off valve 20 prevents the molten metal from flowing from the overflow portion 18 into the suction path 22 by blocking the suction path 22.

The suction path 22 is connected to a gas suction unit 26 through an on-off valve V, a suction path 23, and a switching valve 24. The gas suction unit 26 sucks gas in the cavity portion 14 through the switching valve 24, the suction path 23, the on-off valve V, the suction path 22, and the overflow portion 18. The gas suction unit 26 includes a tank 26*a* and a vacuum pump 26*b*. The gas suction unit 26 sucks gas in the cavity portion 14 by the tank 26*a* depressurized by the vacuum pump 26*b*. Before supplying the molten metal to the cavity portion 14, the gas suction unit 26 sucks the gas in the cavity portion 14. As a result, it is possible to reduce defects (for example, blow holes) in the cast article caused by the mixing of gas into the molten metal.

The gas suction unit 26 and an air supply unit 28 are connected to the switching valve 24. The air supply unit 28 feeds air into (air-blows) the casting mold 12 in an open state, through the switching valve 24, the suction path 23, the on-off valve V, the suction path 22, and the overflow portion 18. As a result, the suction path 22 and the like are cleaned. The on-off valve V opens/closes between the suction path 23 and the suction path 22. The switching valve 24 switches the connection between the suction path 22 and the gas suction unit 26, and the connection between the suction path 22 and the air supply unit 28.

The casting device 10 includes a pressure detector 30 and an imaging unit 32. The pressure detector 30 is disposed in the suction path 23 and detects the pressure of gas in the suction path 23. The pressure of the gas in the suction path 23 varies depending on the suction of the gas by the gas suction unit 26 and the supply of the air from the air supply unit 28. The imaging unit 32 captures an image of a cast article taken out from the casting mold 12. In particular, the imaging unit 32 captures an image of a portion (specific portion) of the cast article that is solidified in the overflow portion 18. The result of this image capturing is used to inspect whether or not the molten metal is filled up to the overflow portion 18. In the present embodiment, the imaging unit 32 is used to detect a defect in a specific portion of the cast article. However, instead of the imaging unit 32, another detection mechanism capable of detecting a defect in the specific portion of the cast article may be used. As the detection mechanism, a detection mechanism (for example, a limit switch) used in normal casting can be used.

The casting device 10 includes a control unit 34, a storage unit 36, and an input/output unit 38. The control unit 34 includes hardware (for example, a processor) and software (for example, a program). The control unit 34 controls the molten metal supply unit 16, the shut-off valve 20, the on-off valve V, the switching valve 24, the gas suction unit 26, and the air supply unit 28. The control unit 34 receives signals from the pressure detector 30 and the imaging unit 32. The storage unit 36 is, for example, a hard disk or a semiconductor memory. The storage unit 36 stores a first time period T1 and a second time period T2 to be described later. The input/output unit 38 is a device for inputting outputting information between the control unit 34 and an operator, and is a keyboard and a display device, for example.

The casting device 10 carries out a casting method in which a preheating step for preheating the casting mold 12 is performed prior to a casting step for producing a cast article as a product.

Figure 2:
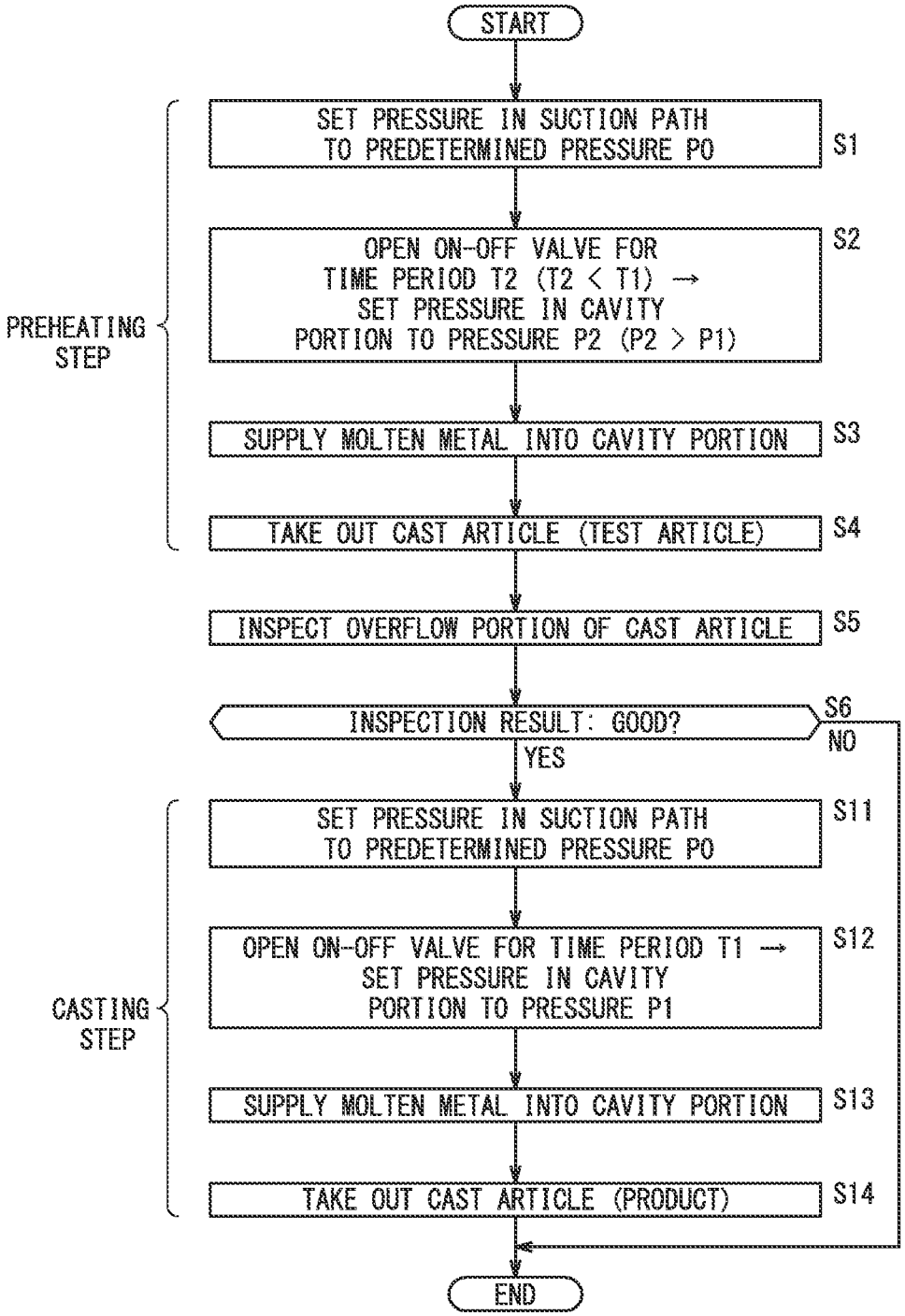
FIG. 2 is a flow chart showing a casting method according to the embodiment.

FIG. 2 is a flow chart showing the casting method according to the embodiment. The casting method is divided into a preheating step and a casting step. Among the steps, the preheating step corresponds to the heating method for the casting mold according to the present embodiment. The casting step is not a step for obtaining a test article, but a step for obtaining a product (a normal casting step or a main casting step). The preheating step is performed under the assumption that the casting step is performed subsequently. Hereinafter, the casting method including the preheating step and the casting step will be described.

Although the order is different from the actual order of execution, the casting step will be described first for ease of understanding. The casting step is a step for producing a cast article as a product. The control unit 34 controls the on-off valve V and the gas suction unit 26 to set the pressure in the suction path 23 to a predetermined pressure P0 in a state where the on-off valve V is closed (a first suction step, step S11). It is preferable that the shut-off valve 20 is opened. When the shut-off valve 20 is opened, the gas in the overflow portion 18 and in the cavity portion 14 can be sucked by opening and closing only the on-off valve V.

The predetermined pressure P0 is set in order to smoothly suck the gas in the cavity portion 14. That is, the gas of the predetermined pressure P0 remaining in the suction path 23 does not inhibit the suction of the gas from the cavity portion 14. The pressure P0 is basically the initial pressure when the vacuum pump 26*b* depressurizes the tank 26*a*. The volume of the tank 26*a* is generally sufficiently larger than that of the suction path 23. Therefore, even if the tank 26*a* sucks the gas in the suction path 23, the pressure in the tank 26*a* does not substantially change.

The predetermined pressure P0 is, for example, 10 to 40 kPa-abs (absolute pressure). Here, the predetermined pressure P0, a first pressure P1 and a second pressure P2, which will be described later, are lower than the atmospheric pressure, in other words, in a state of negative pressure.

Thereafter, the control unit 34 controls the on-off valve V and the gas suction unit 26 to keep the on-off valve V open for the first time period T1. As a result, the gas suction unit 26 sucks the gas in the overflow portion 18 and in the cavity portion 14 through the suction path 23 and the suction path 22 (a second suction step, step S12). At the beginning of gas suction, the inside of the suction path 23 is at the predetermined pressure P0. As described above, if the shut-off valve 20 is opened in advance, it is not necessary to operate the shut-off valve 20. Here, the gas in the overflow portion 18 and in the cavity portion 14 is sucked by the depressurized tank 26*a*. As a result, the pressure in the cavity portion 14 becomes the first pressure P1 (step S12).

The control unit 34 controls the shut-off valve 20 and the molten metal supply unit 16 to close the shut-off valve 20 and thereafter supply the molten metal into the cavity portion 14 set at the first pressure P1 and solidify the molten metal (step S13). By closing the shut-off valve 20 before supplying the molten metal, the molten metal is prevented from flowing into the suction path 22 and the like. Thereafter, a cast article obtained by solidifying the molten metal is taken out as a product (step S14).

On the other hand, the preheating step is basically a step for carrying out casting for preheating the casting mold 12 before producing a cast article as a product. This step means so-called preheating shot. The control unit 34 controls the on-off valve V and the gas suction unit 26 to set the pressure in the suction path 22 to a predetermined pressure P0 in a state where the on-off valve V is closed (a third suction step, step S1). Here, as in the casting step, it is preferable that the shut-off valve 20 is in an open state. This predetermined pressure P0 has the same significance as and can be the same as the predetermined pressure P0 in the casting step. However, the pressure P0 may be different between the preheating step and the casting step.

Thereafter, the control unit 34 controls the on-off valve V and the gas suction unit 26 to keep the on-off valve V open for a second time period T2 shorter than the first time period T1 (T2<T1). As a result, the gas suction unit 26 sucks the gas (basically having an atmospheric pressure initially) in the overflow portion 18 and in the cavity portion 14 through the suction path 22 set at the predetermined pressure P0 (a fourth suction step, step S2). As a result, the pressure in the cavity portion 14 becomes the second pressure P2 (negative pressure) (the fourth suction step, step S2). The second pressure P2 is greater than the first pressure P1 (P2>P1).

The control unit 34 controls the shut-off valve 20 and the molten metal supply unit 16 to close the shut-off valve 20 and thereafter supply the molten metal into the cavity portion 14 set at the second pressure P2 and solidify the molten metal (step S3). As in the casting step, by closing the shut-off valve 20 before supplying the molten metal, the molten metal is prevented from flowing into the suction path 22 and the like. As a result, the casting mold 12 is preheated. Thereafter, a cast article obtained by solidifying the molten metal is taken out as a test product (step S4). By repeating the preheating step (specifically, the third suction step, the fourth suction step, a supply step, and a take-out step) a plurality of times, it is possible to heat the casting mold 12 more reliably. The third suction step comprises a step of setting the pressure in the gas suction unit 26 to the predetermined pressure P0. The fourth suction step is a step of setting the pressure in the cavity portion 14 to the second pressure P2. The supply step is a step of supplying the molten metal. The take-out step is a step of taking out a cast article as a test article.

An image of the test article (cast article) that has been taken out is captured by the imaging unit 32. Based on the image capturing result, the entire cast article including the portion in the overflow portion 18 is inspected (step S5). That is, it is determined whether or not the entire cast article has any release point. The entire cast article includes a portion in the cavity portion 14 (product portion) and a portion in the overflow portion 18. As a result of this inspection, if the release of the cast article from the mold is insufficient, there is a possibility that pieces of the cast article remain inside the mold. In this case, the next casting step is stopped (step S6: NO), and the casting mold 12 is cleaned.

As described above, in the present embodiment, the opening time period (the first time period T1 and the second time period T2) of the on-off valve V is different between steps S2 and S12. The second time period T2 during preheating is shorter than the first time period T1 during casting. That is, the time period during which the on-off valve V is open (the time period during which gas is sucked) is relatively short at the time of the preheating shot, during which powder burrs are relatively likely to occur. As a result, it is possible to suppress the sealing failure caused by adhesion and inclusion of foreign matter such as powder burrs into the seal portion of the shut-off valve 20. As a result, by closing the shut-off valve 20, it is possible to reliably prevent the molten metal from flowing into the suction path 22. In addition, the time for sucking the gas in the cavity portion 14 and the overflow portion 18 during the preheating can be reduced. Reduction of the suction time eventually leads to a reduction in the time required for preheating.

On the other hand, when the second time period T2 is too short, the second pressure P2 becomes large. That is, the difference between the atmospheric pressure and the second pressure P2 becomes small. In this case, when the molten metal is subsequently supplied, it becomes difficult to fill the overflow portion 18 with the molten metal. As a result, it is difficult to determine whether the release of the cast article from the overflow portion 18 is satisfactory. Therefore, the second time period T2 is preferably set to be a relatively short time period within a range that allows the overflow portion 18 to be filled with the molten metal. That is, the second pressure P2 obtained by opening the on-off valve V for the second time period T2 is sufficiently low to enable filling of the overflow portion 18 with the molten metal during the supply of the molten metal. The second time period T2 is set to, for example, 0.1 seconds or more and 0.5 seconds or less, and the second pressure P2 is set to, for example, 40 kPa or more and 90 kPa or less. As a result, the inspection using the overflow portion 18 can be performed, and the time required for preheating can be reduced. The atmospheric pressure is approximately 101 kPa. Therefore, the second pressure P2 of 40 kPa-abs to 90 kPa-abs means that 40% to 90% (for example, 80%) of the gas in the casting mold 12 is sucked. The internal volume of the casting mold 12 basically corresponds to the sum of the internal volume of the cavity portion 14 and the internal volume of the overflow portion 18.

On the other hand, in the casting step, merely filling the overflow portion 18 with the molten metal is not sufficient. That is, in order to reduce defects in the cast article, it is necessary to suppress the mixing of gas into the molten metal. Therefore, the first time period T1 is made relatively long, for example, about one second, so that the first pressure P1 is set to, for example, about 10 kPa-abs or less.

As described above, in the present embodiment, the on-off valve V is opened for the second time period T2 in the preheating shot for performing preheating. The second time period T2 is a relatively short time period within a range that allows the overflow portion 18 to be filled with the molten metal during the supply of the molten metal. Thus, the gas suction unit 26 sucks the gas (basically having an atmospheric pressure initially) in the cavity portion 14 and in the overflow portion 18. That is, in the present embodiment, the time period during which the on-off valve V is open (the time period during which gas is sucked) is relatively short at the time of the preheating shot, during which powder burrs are relatively likely to occur. As a result, it is possible to suppress the sealing failure caused by adhesion and inclusion of foreign matter such as powder burrs into the seal portion of the shut-off valve 20. In addition, the pre-heating time can be shortened, and release of the cast article from the overflow portion 18 can be confirmed.

[Modification]

The present invention is not limited to the above-described embodiment, and various configurations can be adopted therein without departing from the gist of the present invention. For example, in the embodiment, the gas suction is started and stopped by opening and closing the on-off valve V. On the other hand, the gas suction may be started and stopped by opening and closing the shut-off valve 20 instead of the on-off valve V.

In this case, for example, the process proceeds as follows. For example, the on-off valve V is kept in an open state. In steps S1 and S11, the control unit 34 controls the shut-off valve 20 and the gas suction unit 26 to set the pressure in the suction path 23 to the predetermined pressure P0 in a state where the shut-off valve 20 is closed. In steps S2 and S12, the control unit 34 controls the shut-off valve 20 and the gas suction unit 26 to keep the shut-off valve 20 open for the first time period T1 or the second time period T2. As a result, the gas suction unit 26 sucks the gas in the overflow portion 18 and in the cavity portion 14 through the suction path 23 (and the suction path 22) set at the predetermined pressure P0. It should be noted that, since the shut-off valve 20 is closed before the molten metal supply step in steps S3 and S13, it is not necessary to operate the shut-off valve 20.

Invention Obtained from Embodiments

The invention that can be grasped from the above embodiments will be described below.

[1] The heating method for a casting mold is a method for heating a casting mold (12) before casting is performed, wherein the casting mold comprises, on an inside thereof, a cavity portion (14), and an overflow portion (18) connected to the cavity portion, the overflow portion is connected to a gas flow path (suction path 22, 23) provided inside or outside the casting mold, a valve (on-off valve V, shut-off valve 20) is provided between the gas flow path and the overflow portion, and wherein a step of performing the casting comprises: a first suction step (step S11) of setting a pressure in the gas flow path to a predetermined pressure (P0) by sucking gas in the gas flow path in a state in which the valve is closed; a second suction step (step S12) of setting a pressure in the cavity portion to a first pressure (P1) by sucking gas in the overflow portion and in the cavity portion through the gas flow path set at the predetermined pressure while keeping the valve open for a first time period (T1); a step (step S13) of supplying molten metal into the cavity portion set at the first pressure, and solidifying the molten metal; and a step (step S14) of taking out, as a product, a cast article obtained by solidifying the molten metal, the heating method comprising: a third suction step (step S1) of setting the pressure in the gas flow path to the predetermined pressure in the state in which the valve is closed; a fourth suction step (step S2) of setting the pressure in the cavity portion to a second pressure (P2) by sucking the gas in the overflow portion and in the cavity portion through the gas flow path set at the predetermined pressure while keeping the valve open for a second time period (T2) shorter than the first time period; a step (step S3) of supplying the molten metal into the cavity portion set at the second pressure and solidifying the molten metal to heat the casting mold; and a step (step S4) of taking out, as a test article, a cast article obtained by solidifying the molten metal. As a result, the time for sucking the gas is short at the time of the preheating shot, during which foreign matter such as powder burrs is relatively likely to occur. Therefore, adhesion, inclusion and the like of foreign matter into the seal portion of the shut-off valve can be suppressed.

[2] The second pressure is 40 kPa or more and 90 kPa or less. As a result, adhesion, inclusion and the like of foreign matter into the seal portion can be suppressed.

[3] The second time period is 0.1 seconds or more and 0.5 seconds or less. As a result, adhesion, inclusion and the like of foreign matter into the seal portion can be suppressed.

[4] The heating method for the casting mold further comprises a step (step S5) of inspecting the test article to determine whether a state of filling of the overflow portion with the molten metal is good, and the casting is performed when the state of filling is determined to be good in the determining step (step S6: YES).

[5] In the heating method for the casting mold, the step of setting the pressure in the gas flow path to the predetermined pressure, the step of setting the pressure in the cavity portion to the second pressure, the step of supplying the molten metal, and the step of taking out the cast article as the test article are repeated a plurality of times. This makes it possible to suppress adhesion, inclusion and the like of foreign matter into the seal portion of the shut-off valve during a plurality of preheating shots.

[6] The casting mold includes, on the inside thereof, a first gas flow path (suction path 22) including one end connected to the cavity portion via the overflow portion, and a first valve (shut-off valve 20) disposed between the overflow portion and the first gas flow path and configured to open and close the first gas flow path, a second gas flow path (suction path 23) connected to another end of the first gas flow path is provided outside the casting mold, a second valve (on-off valve V) is provided between the first gas flow path and the second gas flow path, in the first suction step, one of the first valve or the second valve is opened and another of the first valve and the second valve is closed, in the second suction step, the pressure in the cavity is set to the first pressure while the another of the first valve and the second valve is kept open for the first time period in a state in which the one of the first valve or the second valve is opened, in the third suction step, the one of the first valve or the second valve is opened, and the another of the first valve and the second valve is closed, and in the fourth suction step, the pressure in the cavity portion is set to the second pressure while the another of the first valve and the second valve is kept open for the second time period in the state in which the one of the first valve or the second valve is opened. As a result, the preheating shot and the casting can be performed by operating the first valve and the second valve disposed inside and outside the casting mold.

[7] A casting device 10 is a casting device that heats a casting mold before casting is performed, the casting mold including, on an inside thereof, a cavity portion and an overflow portion connected to the cavity portion, the casting device comprising: a gas suction unit (26) configured to suck gas in the overflow portion and in the cavity portion through a gas flow path provided inside or outside the casting mold; a valve provided between the gas flow path and the overflow portion; a molten metal supply unit (16) configured to supply molten metal into the cavity portion; and a control unit (34) configured to control the valve, the gas suction unit, and the molten metal supply unit, wherein during the casting, the control unit executes: a first suction step of setting a pressure in the gas flow path to a predetermined pressure by controlling the gas suction unit and the valve to cause the gas suction unit to suck gas in the gas flow path in a state in which the valve is closed; a second suction step of setting a pressure in the cavity portion to a first pressure by controlling the gas suction unit and the valve to cause the gas suction unit to suck gas in the overflow portion and in the cavity portion through the gas flow path set at the predetermined pressure while the valve is kept open for a first time period; and a step of controlling the molten metal supply unit to supply molten metal into the cavity portion set at the first pressure and solidify the molten metal, and during heating, the control unit causes the casting mold to be heated by executing: a third suction step of setting the pressure in the gas flow path to the predetermined pressure by controlling the gas suction unit and the valve to cause the gas suction unit to suck the gas in the gas flow path in the state in which the valve is closed; a fourth suction step of setting the pressure in the cavity portion to a second pressure by controlling the gas suction unit and the valve to cause the gas suction unit to suck the gas in the overflow portion and in the cavity portion through the gas flow path set at the predetermined pressure while the valve is kept open for a second time period shorter than the first time period; and a step of controlling the molten metal supply unit to supply the molten metal into the cavity portion set at the second pressure and solidify the molten metal. As a result, since the time for sucking the gas is short at the time of the preheating shot, during which foreign matter such as powder burrs is relatively likely to occur. Therefore, adhesion, inclusion and the like of foreign matter into the seal portion of the shut-off valve can be suppressed.

[8] The second pressure is 40 kPa or more and 90 kPa or less. As a result, adhesion, inclusion and the like of foreign matter into the seal portion can be suppressed.

[9] The second time period is 0.1 seconds or more and 0.5 seconds or less. As a result, adhesion, inclusion and the like of foreign matter into the seal portion can be suppressed.

[10] The casting mold includes, on the inside thereof, a first gas flow path including one end connected to the cavity portion via the overflow portion, and a first valve disposed between the overflow portion and the first gas flow path and configured to open and close the first gas flow path, the casting device further comprising: a second gas flow path connected to another end of the first gas flow path and provided outside the casting mold; and a second valve disposed between the first gas flow path and the second gas flow path, and the control unit controls the first valve and the second valve to: in the first suction step, open one of the first valve or the second valve and close another of the first valve and the second valve; in the second suction step, set the pressure in the cavity portion to the first pressure while the another of the first valve and the second valve is kept open for the first time period in a state in which the one of the first valve or the second valve is opened; in the third suction step, open the one of the first valve or the second valve and close the another of the first valve and the second valve; and in the fourth suction step, set the pressure in the cavity portion to the second pressure while the another of the first valve and the second valve is kept open for the second time period in the state in which the one of the first valve or the second valve is opened. As a result, the preheating shot and the casting can be performed by operating the first valve and the second valve disposed inside and outside the casting mold.

What is claimed is:

1. A method for a casting mold for heating the casting mold before casting is performed, wherein the casting mold includes, on an inside thereof, a cavity portion, and an overflow portion connected to the cavity portion, the overflow portion is connected to a gas flow path provided inside or outside the casting mold, a valve is provided between the gas flow path and the overflow portion, and wherein the method comprising:

a first suction step of setting a pressure in the gas flow path to a predetermined pressure in a state in which the valve is closed;

a second suction step of setting the pressure in the cavity portion to a first pressure by sucking the gas in the overflow portion and in the cavity portion through the gas flow path set at the predetermined pressure while keeping the valve open for a first time period shorter than a second time period;

a step of supplying molten metal into the cavity portion set at the first pressure and solidifying the molten metal to heat the casting mold; and a step of taking out, as a test article, a cast article obtained by solidifying the molten metal, a step of performing the casting comprises:

a third suction step of setting the pressure in the gas flow path to the predetermined pressure by sucking gas in the gas flow path in the state in which the valve is closed;

a fourth suction step of setting a pressure in the cavity portion to a second pressure by sucking gas in the overflow portion and in the cavity portion through the gas flow path set at the predetermined pressure while keeping the valve open for the second time period;

a step of supplying the molten metal into the cavity portion set at the second pressure, and solidifying the molten metal; and a step of taking out, as a product, a cast article obtained by solidifying the molten metal.

2. The method for the casting mold according to claim 1, wherein the first pressure is 40 kPa or more and 90 kPa or less.

3. The method for the casting mold according to claim 1, wherein the first time period is 0.1 seconds or more and 0.5 seconds or less.

4. The method for the casting mold according to claim 1, further comprising a step of inspecting the test article to determine whether a state of filling of the overflow portion with the molten metal is good, wherein the casting is performed when the state of filling is determined to be good in the determining step.

5. The method for the casting mold according to claim 1, wherein in the method the step of setting the pressure in the gas flow path to the predetermined pressure, the step of setting the pressure in the cavity portion to the first pressure, the step of supplying the molten metal, and the step of taking out the cast article as the test article are repeated a plurality of times.

6. The method for the casting mold according to claim 1, wherein the casting mold includes, on the inside thereof, a first gas flow path including one end connected to the cavity portion via the overflow portion, and a first valve disposed between the overflow portion and the first gas flow path and configured to open and close the first gas flow path, a second gas flow path connected to another end of the first gas flow path is provided outside the casting mold, and a second valve is provided between the first gas flow path and the second gas flow path, and wherein in the third suction step, one of the first valve or the second valve is opened and another of the first valve and the second valve is closed, in the fourth suction step, the pressure in the cavity is set to the second pressure while the another of the first valve and the second valve is kept open for the first time period in a state in which the one of the first valve or the second valve is opened, in the first suction step, the one of the first valve or the second valve is opened, and the another of the first valve and the second valve is closed, and in the second suction step, the pressure in the cavity portion is set to the first pressure while the another of the first valve and the second valve is kept open for the first time period in the state in which the one of the first valve or the second valve is opened.

7. A casting device that heats a casting mold before casting is performed, the casting mold including, on an inside thereof, a cavity portion, and an overflow portion connected to the cavity portion, the casting device comprising:

a gas suction unit configured to suck gas in the overflow portion and in the cavity portion through a gas flow path provided inside or outside the casting mold;

a valve provided between the gas flow path and the overflow portion;

a molten metal supply unit configured to supply molten metal into the cavity portion; and a control unit configured to control the valve, the gas suction unit, and the molten metal supply unit, wherein during heating, the control unit causes the casting mold to be heated by executing:

a first suction step of setting a pressure in the gas flow path to a predetermined pressure by controlling the gas suction unit and the valve to cause the gas suction unit to suck the gas in the gas flow path in a state in which the valve is closed;

a second suction step of setting the pressure in the cavity portion to a first pressure by controlling the gas suction unit and the valve to cause the gas suction unit to suck the gas in the overflow portion and in the cavity portion through the gas flow path set at the predetermined pressure while the valve is kept open for a first time period shorter than a second time period; and a step of controlling the molten metal supply unit to supply the molten metal into the cavity portion set at the first pressure and solidify the molten metal, and during casting, the control unit executes:

a third suction step of setting a pressure in the gas flow path to the predetermined pressure by controlling the gas suction unit and the valve to cause the gas suction unit to suck gas in the gas flow path in a state in which the valve is closed;

a fourth suction step of setting the pressure in the cavity portion to a second pressure by controlling the gas suction unit and the valve to cause the gas suction unit to suck gas in the overflow portion and in the cavity portion through the gas flow path set at the predetermined pressure while the valve is kept open for the second time period; and a step of controlling the molten metal supply unit to supply molten metal into the cavity portion set at the second pressure and solidify the molten metal.

8. The casting device according to claim 7, wherein the first pressure is 40 kPa or more and 90 kPa or less.

9. The casting device according to claim 7, wherein the first time period is 0.1 seconds or more and 0.5 seconds or less.

10. The casting device according to claim 7, wherein the casting mold includes, on the inside thereof, a first gas flow path including one end connected to the cavity portion via the overflow portion, and a first valve disposed between the overflow portion and the first gas flow path and configured to open and close the first gas flow path, the casting device further comprises:

a second gas flow path connected to another end of the first gas flow path and provided outside the casting mold; and a second valve disposed between the first gas flow path and the second gas flow path, and wherein in the third suction step, the control unit controls the first valve and the second valve to open one of the first valve or the second valve and close another of the first valve and the second valve;

in the fourth suction step, the control unit controls the first valve and the second valve to set the pressure in the cavity portion to the second pressure while the another of the first valve and the second valve is kept open for the first time period in a state in which the one of the first valve or the second valve is opened;

in the first suction step, the control unit controls the first valve and the second valve to open the one of the first valve or the second valve and close the another of the first valve and the second valve; and in the second suction step, the control unit controls the first valve and the second valve to set the pressure in the cavity portion to the first pressure while the another of the first valve and the second valve is kept open for the first time period in the state in which the one of the first valve or the second valve is opened.

* * * * *